US007272902B2

(12) United States Patent
Ericson

(10) Patent No.: US 7,272,902 B2
(45) **Date of Patent: *Sep. 25, 2007**

(54) BI-DIRECTIONAL VISUAL DISPLAY ASSEMBLY

(75) Inventor: Greg Ericson, Memphis, TN (US)

(73) Assignee: Ericson Group, Inc., Memphis, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/395,063

(22) Filed: Mar. 25, 2003

(65) Prior Publication Data

US 2003/0196359 A1 Oct. 23, 2003

Related U.S. Application Data

(62) Division of application No. 09/973,008, filed on Oct. 10, 2001, now Pat. No. 6,578,301.

(51) Int. Cl.
*G09F 15/00* (2006.01)

(52) U.S. Cl. ..... 40/606; 312/234.1; 40/572; 211/119.005

(58) Field of Classification Search ..... 40/572, 40/606, 609, 791, 792; 248/156; 312/234, 312/234.1; 211/119.005, 119.013
See application file for complete search history.

(56) References Cited

U.S. PATENT DOCUMENTS 1,429,211 A 9/1922 Lightburn
1,702,692 A 2/1929 Henderson
1,788,278 A * 1/1931 Cortelyou ..... 40/607.03
3,572,045 A 3/1971 Owen
4,125,243 A 11/1978 Liptak
4,380,880 A 4/1983 Gandy
4,523,400 A 6/1985 Seely
4,586,207 A 5/1986 Cornette
4,773,622 A 9/1988 Herlin
5,295,500 A 3/1994 Leu
5,397,125 A 3/1995 Adams
5,470,038 A 11/1995 Clark
5,579,599 A 12/1996 Haeseler
5,682,696 A 11/1997 Gill
5,799,767 A 9/1998 Molbak
5,813,927 A 9/1998 Anglea
5,815,971 A * 10/1998 Rothe et al. ..... 40/718
6,015,124 A 1/2000 Loy
6,449,888 B1 * 9/2002 Gibbs ..... 40/575

OTHER PUBLICATIONS

Declaration Regarding Use and Sale of Visual Display by Greg Ericson, dated Jul. 19, 2006, 6 pages.

* cited by examiner

*Primary Examiner*—Joanne Silbermann
(74) *Attorney, Agent, or Firm*—Weide & Miller, Ltd.

(57) ABSTRACT

A visual display mounting assembly has first and second vertical metal plate legs and transverse stop plates extending in cantilever manner from opposite sides of the vertical legs at a position spaced above the lower ends of the leg. A visual display support means is attached to the upper ends of the legs and includes pivotal clamp frame means for clamping a display sign, poster or other visible sheet in position on each side of the display means so that the device can be positioned between rows of vending or gaming machines to provide visible access of the display to users of either row. In a second back-lit embodiment fluorescent rubes are provided between translucent plastic support panels.

11 Claims, 7 Drawing Sheets

$1,000,000
JACKPOT
10
12
13
14
15
16
17
18
20
26
28
30
32
34
42
46
48
52
60
62
64
66
66R
68
68R
3
4

BI-DIRECTIONAL VISUAL DISPLAY ASSEMBLY

This is a divisional of U.S. application No. 09/973,008, filed 10 Oct. 2001, now U.S. Pat. No. 6,578,301 which is incorporated herein by reference in its entirety.

BACKGROUND OF THE INVENTION

The present invention is in the field of visual display devices and is more specifically directed to a unique visual display of a bi-directional view capability, which can be mounted between the back-facing surfaces to back-to-back rows of gaming or vending machines for encouraging use or providing other messages for customers or users of both rows of such machines. One contemplated usage of the present invention is in connection with back-to-back rows of slot machines; however, usage of the subject invention is not limited to slot machines since the invention has equal applicability for usage with other types of vending machines, including but not limited to, merchandise display cabinets and the like.

The field of signs and display devices is replete with devices providing back-to-back or double-sided displays of information such as exemplified in U.S. Pat. Nos. 5,579,599 and 5,682,696. Other prior devices such as U.S. Pat. Nos. 1,429,211; 5,295,500 and 5,799,767 are directed to various types of apparatus for attaching a sign to supporting structures such as posts, automobiles and the like. Similarly, the use of signs with gaming devices such as slot machines is well known and is exemplified in U.S. Pat. No. 5,397,125 in which a forwardly-facing sign is provided on fixedly extending vertical pipes attached to the base on which the slot machine rests. However, the prior art is devoid of any teaching of double-sided signs or other display materials which can be easily changed and in which a single sign is visible by users of two back-to-back gaming machines while being easily replaceable without need for mechanical connection or disassembly of any sort.

Therefore, there remains an unmet need for display assemblies or apparatus, which can be easily associated with or removed from association with back-to-back machines such as gaming machines or the like without there being any need for mechanical connection, disconnection or other time consuming and expensive procedures.

Therefore, it is the primary object of the present invention to provide a new and improved display apparatus for mounting on back-to-back gaming or other devices, which can provide messages to persons viewing such devices from the front of either of the devices.

A further object of the present invention is the provision of a new and improved sign assembly, which can be positioned on and supported in stable manner between two rows of devices arranged in back-to-back manner.

Yet another object of the present invention is to provide a new and improved back-lit display apparatus for mounting on back-to-back gaming or other devices, which can provide messages to persons viewing such devices from the front of either of the devices.

An additional object of the present invention is the provision of a new and improved back-lit sign assembly, which can be positioned on and supported in a stable manner between two rows of devices arranged in back-to-back manner.

Yet another object of the present invention is the provision of a new and improved display means having leg-type supports resting on the tops of back-to-back devices and including means engaging such devices for providing horizontal stability.

BRIEF SUMMARY OF THE INVENTION

Achievement of the foregoing objects of the invention is enabled by the preferred embodiments of the invention through the provision of a display mounting assembly comprising first and second vertical metal legs having transverse stop plate means extending in cantilever manner from opposite sides of each leg. The stop plate means is positioned above the lower end of the leg, which is extended downwardly into an open space or valley between back-to-back rows of gaming or vending machines. Visual display support means comprising fiber panels, boards or the like are attached to the upper ends of the vertical legs and include clamp frame members defining a rectangular periphery of the display support means and which are operable to receive and clamp posters, signs or the like on outwardly facing surfaces of the assembly so that such signs are visible to users of either row of vending or gaming machines.

An alternative embodiment of the invention comprises a back-lit display mounting assembly in which translucent support panels are provided in place of fiber panels or boards and fluorescent light tubes or other light sources are incorporated between the translucent panels for effecting display of transparency type posters, signs or the like. The back-lit embodiment is identical to the first embodiment with the exception of the fact that the translucent support panels are spaced apart a greater distance than the fiber panels of the first embodiment so as to accommodate positioning of the fluorescent tubes.

Alternative embodiments additionally include rounded corner construction, which can be used with either the first embodiment or the alternative back-lit embodiment if desired.

DETAILED DESCRIPTION OF THE INVENTION

Figures 1, 2:
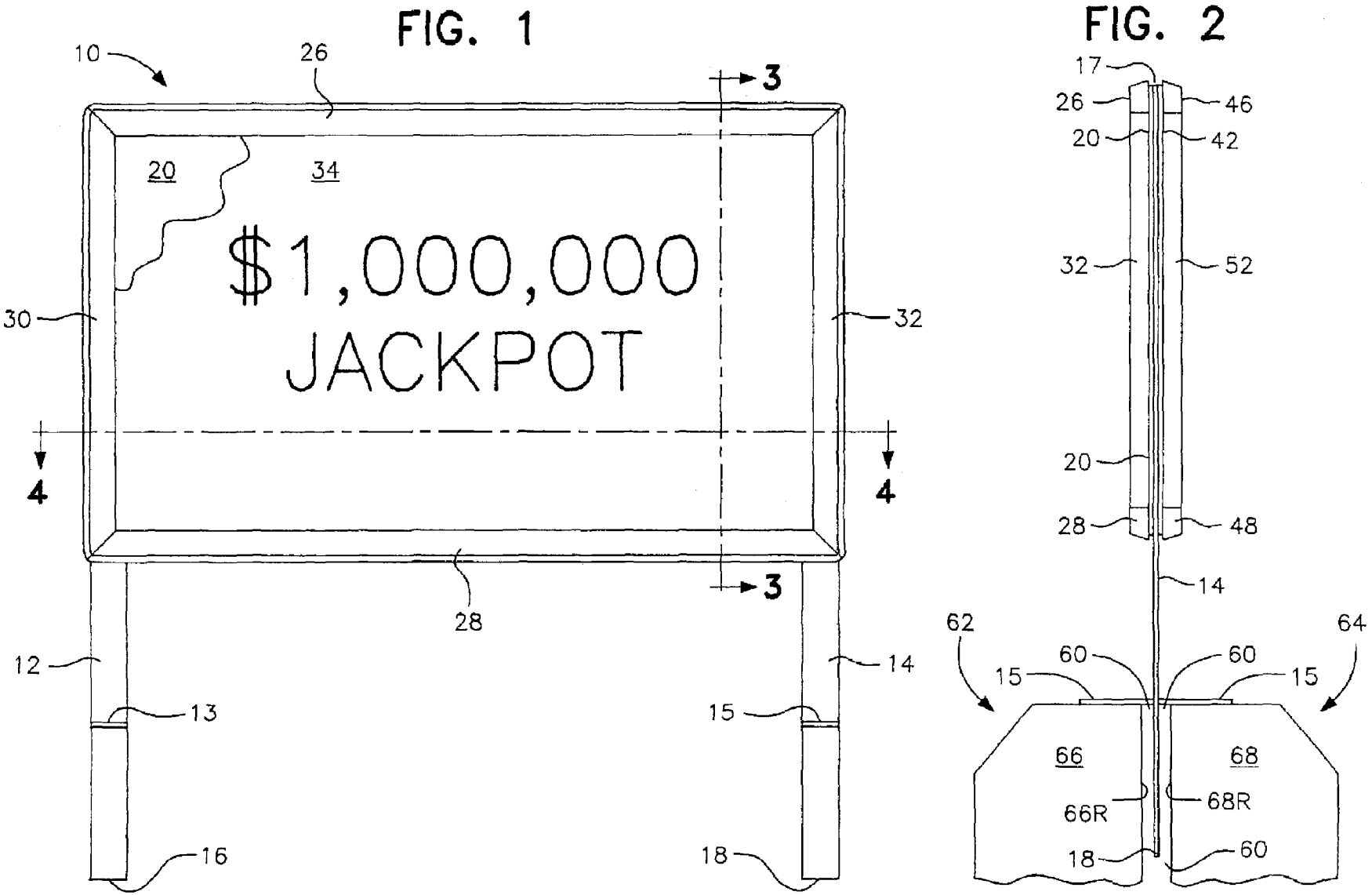
FIG. 1 is a front elevation of the preferred embodiment of the invention.
FIG. 2 is a right side elevation of the preferred embodiment of the invention.

Achievement of the foregoing objects of the present invention is enabled by the preferred embodiment which is generally designated 10 and which includes a first or left vertical leg 12 and a second or right vertical leg 14, both of which are identical to each other and are formed of vertical steel or other metal plate material. The first vertical leg 12 has a lower end 16 and the second vertical leg 14 similarly has a lower end 18. The first vertical leg 12 has two horizontally aligned transverse stop plates 13 extending from it in opposite directions (only one stop plate is shown in the drawings).

The second vertical leg 14 is identical to first vertical leg 12 and has two transverse stop plates 15 which extend outwardly perpendicular to vertical leg 14 and also has an upper end 17 as shown in FIG. 2. The first vertical leg similarly has an upper end, which is not shown. First vertical leg 12 is identical to second vertical leg 14 and the end elevation view taken from the left side of the device of FIG. 1 would be structurally identical to FIG. 2. It should also be noted that a rear elevation view of the preferred embodiment would be identical to the front elevation view of FIG. 1 with the exception of the fact that the position of vertical legs 12 and 14 would be reversed.

Figure 3:
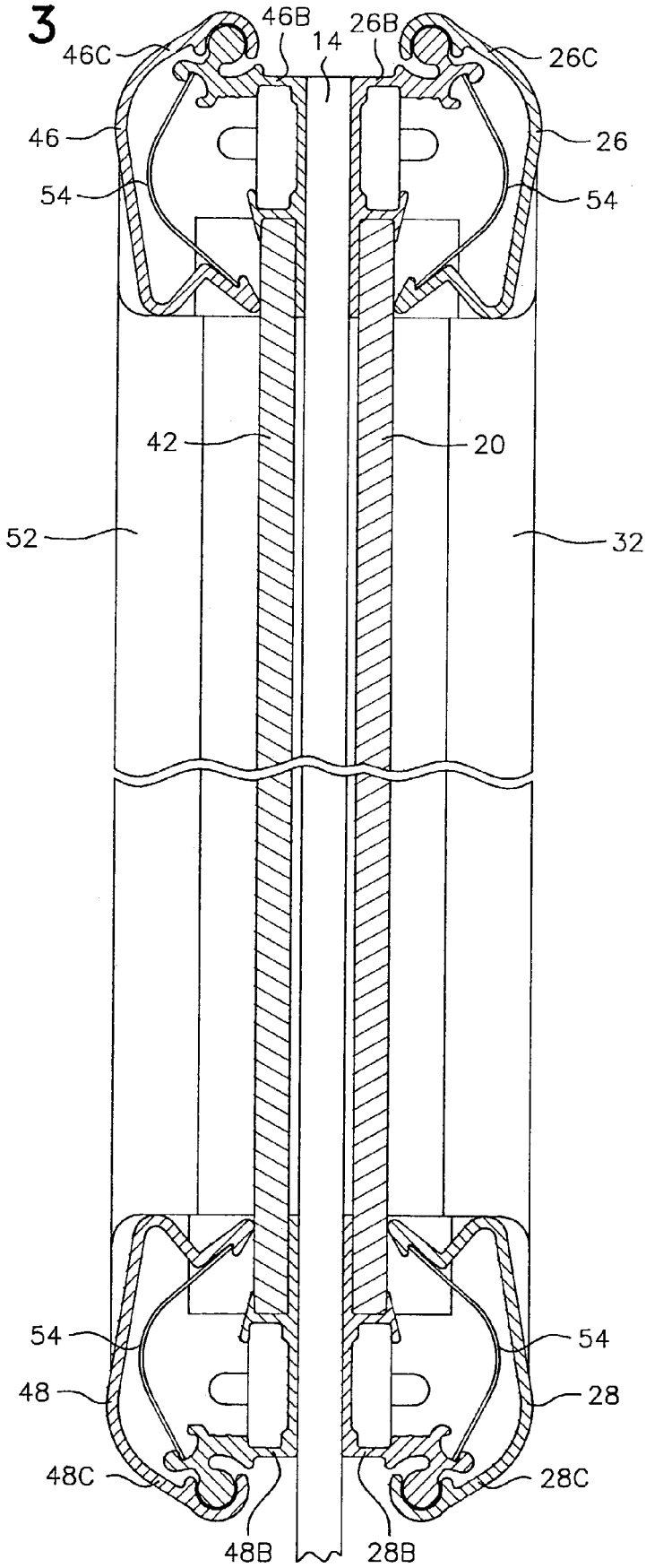
FIG. 3 is a sectional view taken along line 3-3 of FIG. 1.

A front sheet display support panel 20 formed of fiber board or the like is supported in a rectangular front border frame which is attached to the front surfaces of the first vertical leg 12 and the second vertical leg 14 and has an upper edge approximately coextensive with the upper end 17 (FIG. 2) of vertical leg 14 and the corresponding upper end of leg 12. The front border frame comprises a horizontal upper clamp frame assembly 26, a horizontal lower clamp frame assembly 28, a left vertical clamp frame assembly 30 and a right vertical clamp frame assembly 32 which enables retention of a front display sheet 34 on display support panel 20. The display sheet is formed of paper, cardboard, metal, plastic or the like and provides a desired visual message. Sheet 34 has been omitted from FIGS. 3 and 4 for purposes of clarity.

Figure 4:
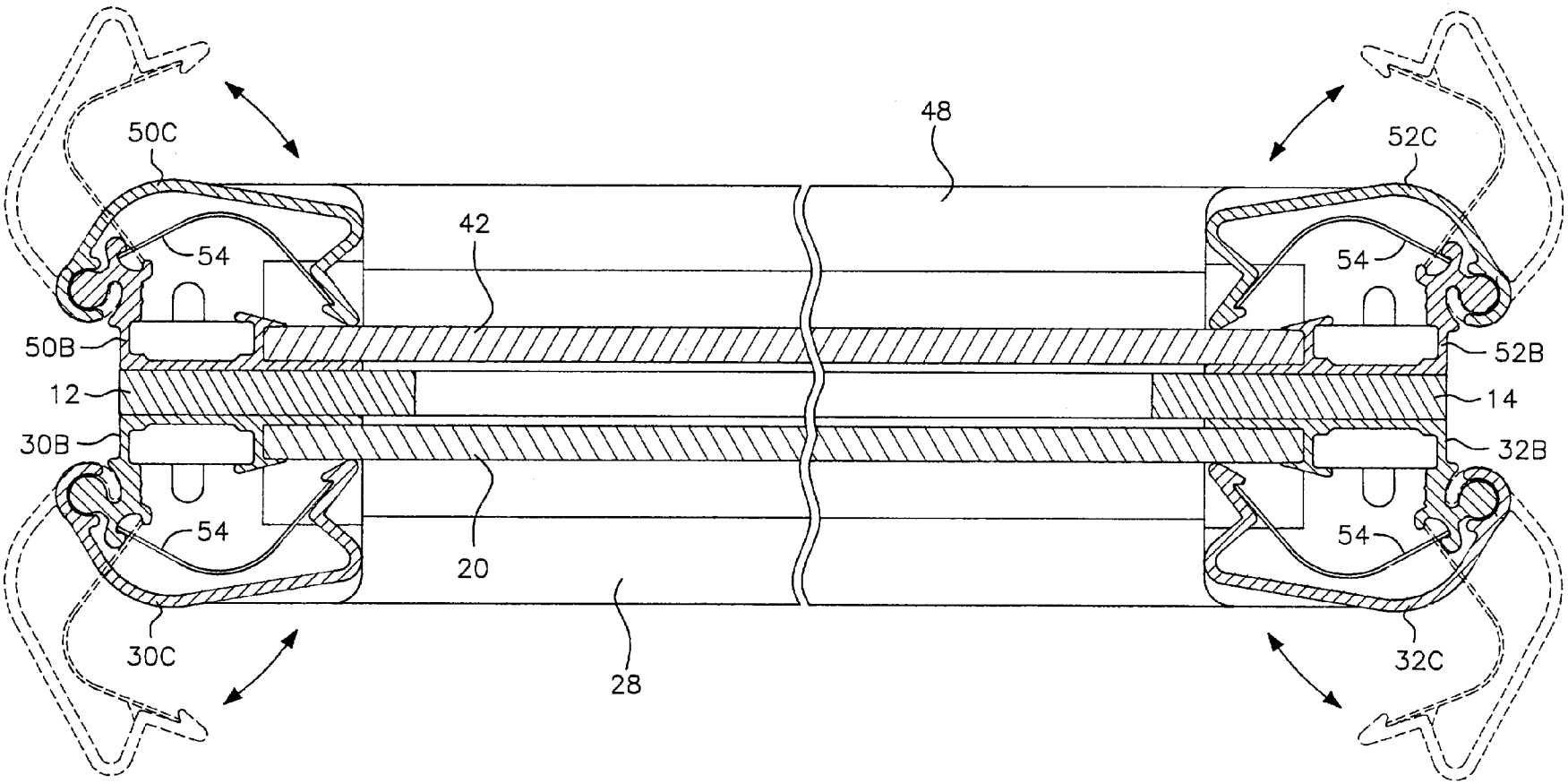
FIG. 4 is a sectional view taken along line 4-4 of FIG. 1.

Similarly, a rear sheet display support panel 42 (FIG. 2) formed of fiber board or the like is horizontally aligned with the front sheet display support panel 22 and is supported in a rectangular rear border frame which is identical to the front border frame and is attached to the rear surfaces of the upper portions of the vertical legs 12 and 14. The rear border frame comprises a rear upper horizontal clamp frame assembly 46, a rear lower horizontal clap frame assembly 48 (FIG. 3), a left rear vertical clamp frame assembly 50, and a right rear vertical clamp frame assembly 52 (FIG. 4). The aforementioned rear clamp frame assembly components are identical to the clamp frame components 26, 28, 30 and 32 and enable mounting of a rear display sheet in the same manner as front display sheet 34.

It should be understood that the clamp frame components 26, 28, 30, 32, 42, 46, 48, 50 and 52 are conventional extruded metal which respectively each have base members 26B, 28B, 30B, 32B, 42B, 46B, 48B, 50B and 52B which receive and retain one edge of one of the support panels 20 or 42. The base members pivotally support sheet clamps 26C, 28C, 30C, 32C, 42C, 46C, 50C and 52C. The front base members 26B, 28B, 30B and 32B are attached to the front surfaces of vertical legs 12 and 14 and the rear base members 46B, 48B 50B and 52B are attached to the rear surfaces of vertical legs 12 and 14. Each of the sheet clamp components 26C, 28C, etc. is biased by an over-center spring 54 into either a clamping position shown in solid lines or an open position shown on dashed lines in FIG. 4. Each spring 54 urges its respective sheet clamp 26C, 28C, etc. to either position when manually moved past an over-center position. The foregoing clamp frame components are indicated by the manufacturer as being covered by one or more of U.S. Pat. Nos. 4,145,828; 4,512,095; 4,519,152; 4,523,400; 4,714,220; 4,937,959 and 4,958,458.

In use, the preferred embodiment of the invention is positioned so that the lower ends of the vertical legs 12 and 14 extend downwardly into an open or valley space 60 (FIG. 2) between back-to-back parallel rows 62 and 64 of vending or slot machines 66 and 68 which respectively have rear surfaces 66R and 68R. The downwardly facing surfaces of the transverse stop plates 13 and 15 are positioned above the bottom ends of vertical legs 12 and 14 a distance which exceeds the width of valley space 60 and rest on the upper surfaces of the rows of devices 66 and 68 to provide support for the display assembly with the lower end portions extending downwardly into the valley providing transverse stability so that the display assembly cannot fall over or create a hazard for persons in the vicinity.

Figure 5:
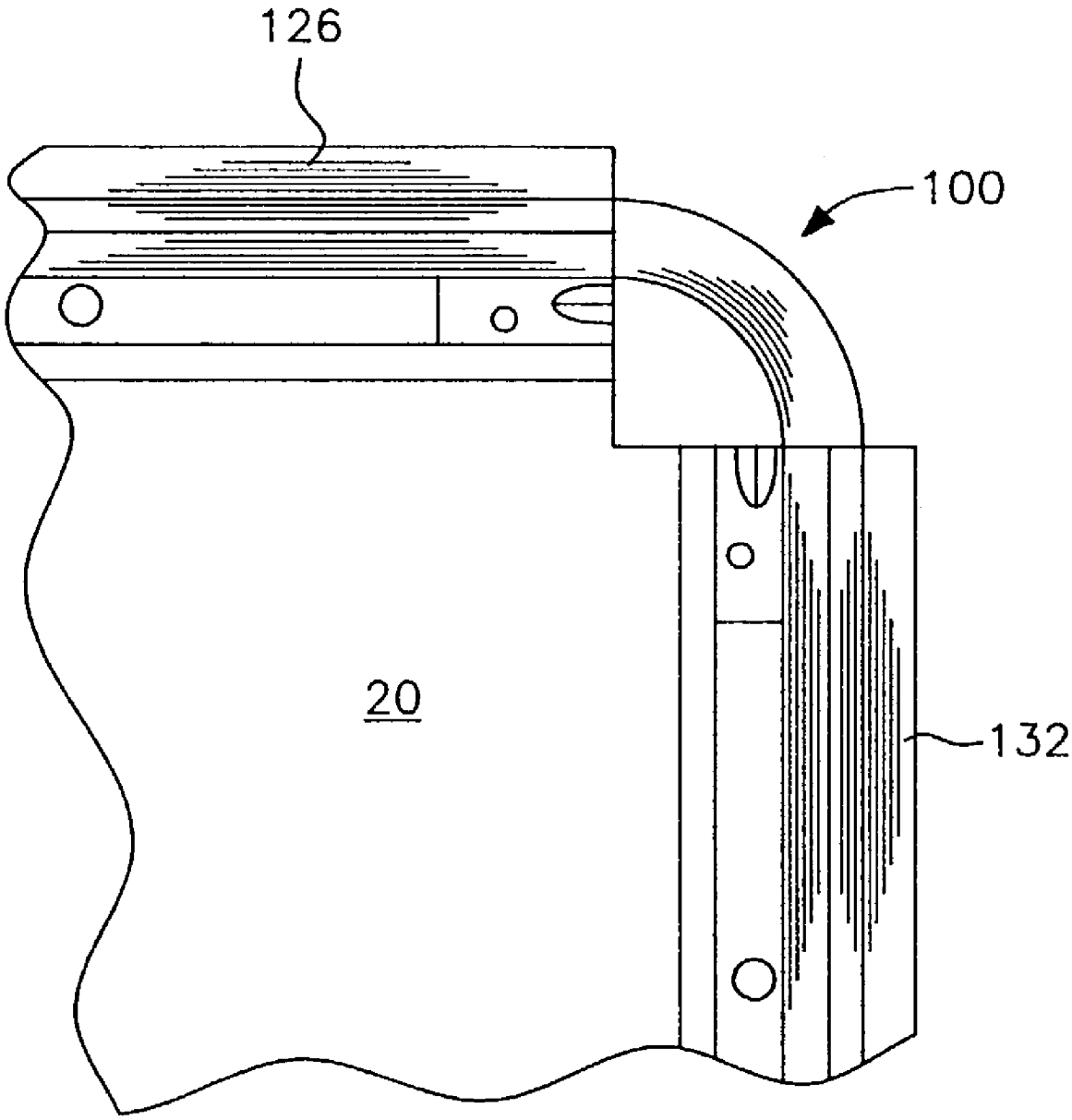
FIG. 5 is a front elevation of an alternative rounded corner embodiment of the invention.

FIG. 5 illustrates an alternative arrangement comprising a rounded corner assembly, which can be used on all four corners instead of the square corner arrangement of the embodiment of FIGS. 1 through 4. Only one such corner 100 is illustrated; however, it should be understood that the other corners would be identical in construction. The modified construction necessarily includes pivotal clamp members 126 and 132, which are reduced in length as compared to the corresponding clamp members 26 and 32 of the first embodiment. While not shown, the modified embodiment would also use reduced length clamp members in place of clamps 28 and 30 of the first embodiment.

Figure 6:
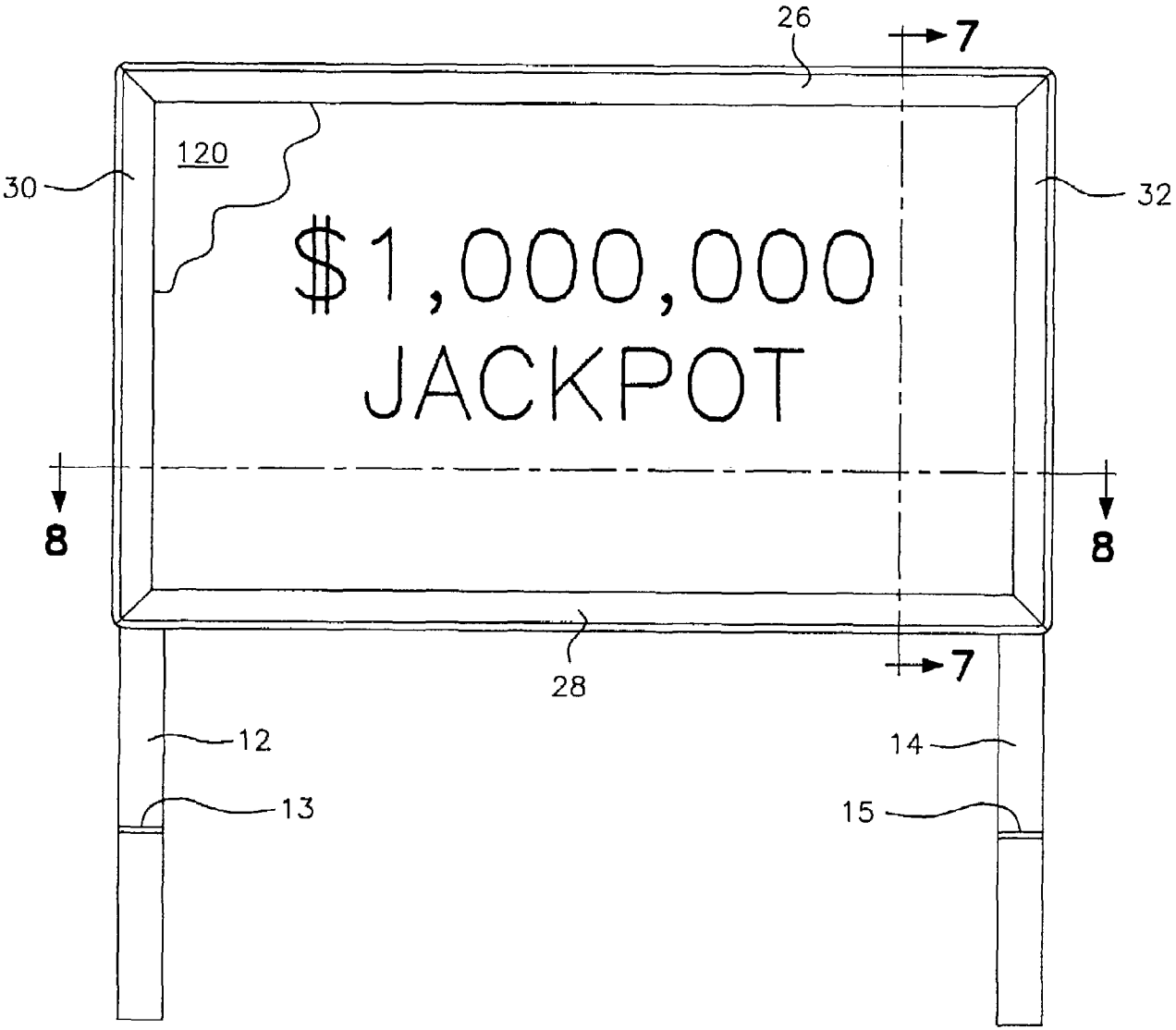
FIG. 6 is a front elevation of a back-lit embodiment of the invention.
Figure 7:
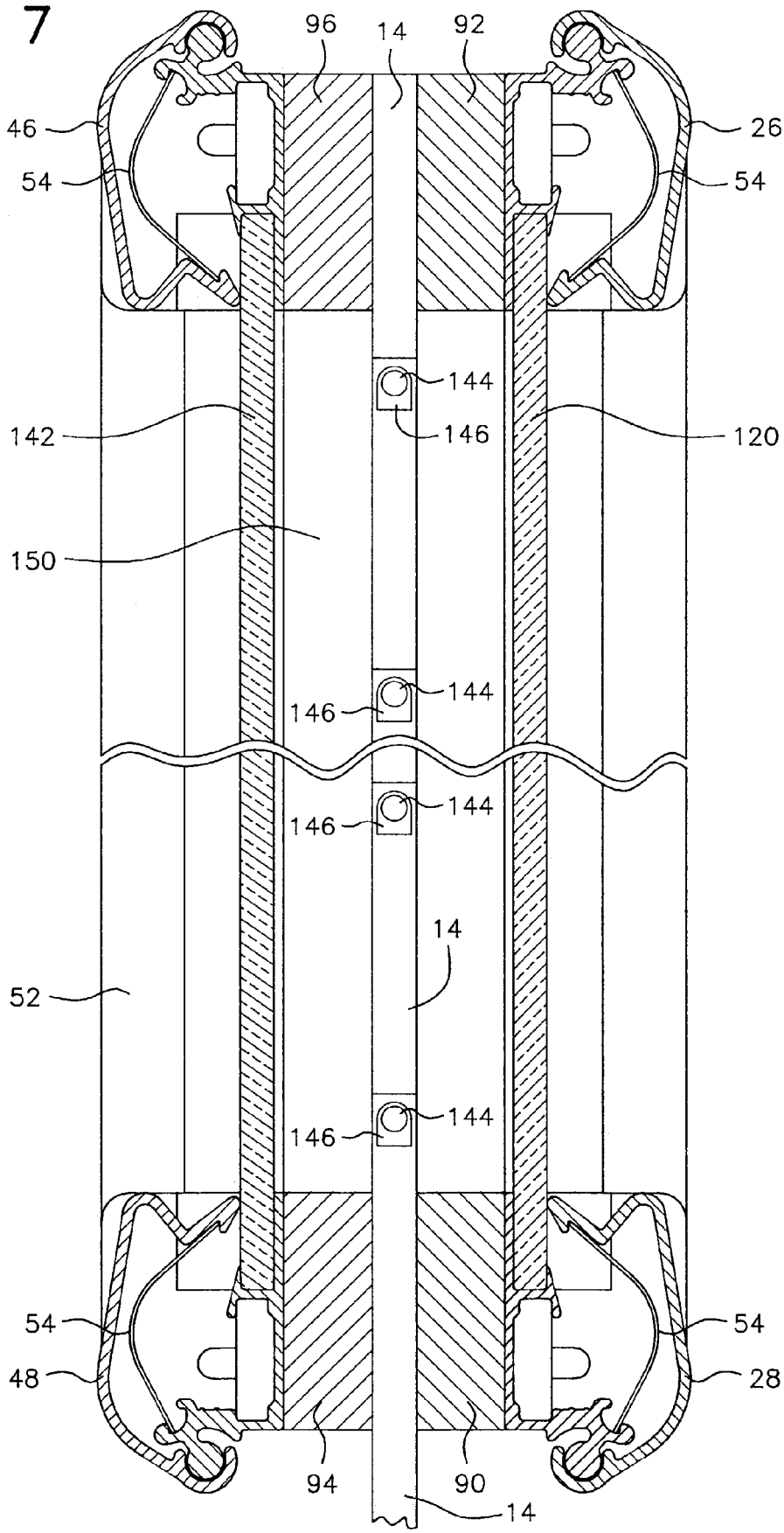
FIG. 7 is a sectional view taken along line 7-7 of FIG. 6.
Figure 8:
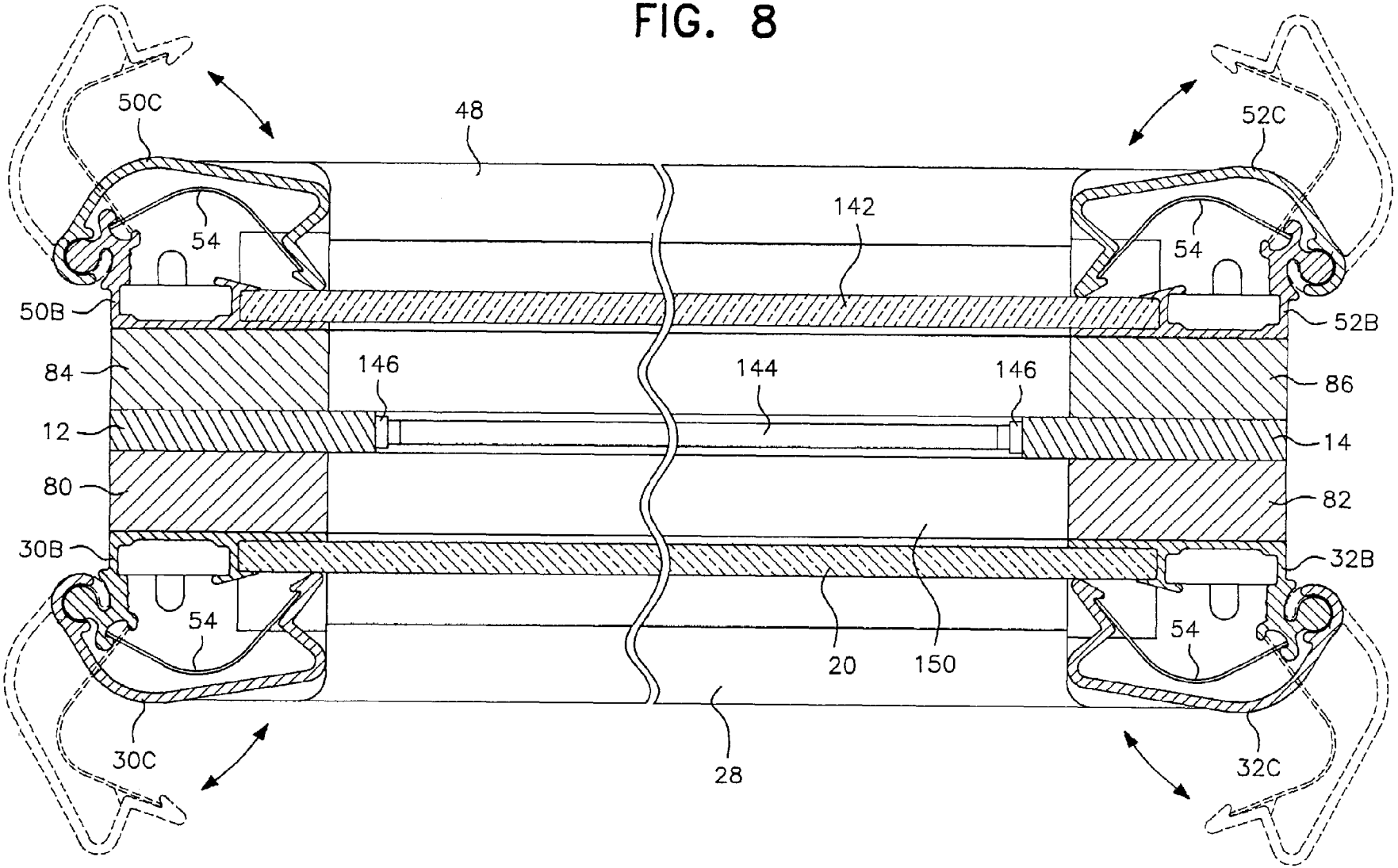
FIG. 8 is a sectional view taken along line 8-8 of FIG. 6.

FIGS. 6, 7 and 8 illustrate an alternative back-lit embodiment, which is identical to the embodiment of FIGS. 1 through 4 with the exception of the fact that the back-lit embodiment employs a front translucent plastic display support panel 120 in place of support panel 20 of the first embodiment and a rear translucent plastic display support panel 142 (FIG. 7) in place of rear support panel 42 of the first embodiment. Additionally, a plurality of fluorescent light tubes 144 are positioned internally of the space between the translucent plastic display support panels 120 and 142 as shown in FIGS. 7 and 8. Each of the fluorescent light tubes 144 is supported at each end by a conventional fitting 146 mounted on the inwardly facing surfaces of legs 12 and 14 in the manner illustrated in FIG. 8. Electrical current is supplied to the fluorescent tubes in a conventional manner. It should be understood that the use of fluorescent tubes is not mandatory for practice of the invention since other conventional light sources could also be used if desired.

The back-lit embodiment of FIGS. 6, 7 and 8 also differs from the first embodiment by the inclusion of front vertical spacer plates 80 and 82 attached to the front surfaces of legs 10 and 12 and rear vertical spacer plates 84 and 86 which are attached to the rear faced surfaces of legs 12 and 14 as shown in FIG. 8. Similarly, front horizontal spacer plates 90 and 92 extend between the front surfaces of each of the vertical legs 12 and 14 as shown in FIG. 7 and identical rear horizontal spacer plates 94 and 96 extend between legs 12 and 14 and are connected to the rear surfaces of legs 12 and 14. The spacer plates separate the front and rear clamp assemblies sufficiently to provide a space 150 of sufficient front to rear dimension between the translucent plastic display support panels 120 and 142 to easily receive the fluorescent tubes 144 as shown in FIGS. 7 and 8.

It should be understood that various other modifications of the preferred embodiment will undoubtedly occur to those of skill in the art and the spirit and scope of the invention is to be limited solely by the appended claims.

The invention claimed is:

1. A visual display assembly comprising, in combination:

at least two gaming machines;

a visual display comprising:

a visual display support, said visual display support having a first end and a second end and comprising:

a first translucent display panel and a second translucent display panel extending generally parallel to one another and spaced from one another, said first and second translucent display panels having a generally rectangular periphery comprising a top, a bottom, a first end and a second end;

a first border frame extending about said periphery of said first translucent display panel and supporting said first translucent display panel;

a second border frame extending about said periphery of said second translucent display panel and supporting said second translucent display panel; and at least one light source positioned at an interior space of said visual display support defined between said first and second translucent panels, whereby said at least one light source back-lights said translucent panels;

a first support leg having a top portion and a bottom portion, said top portion positioned at said first end of said visual display support and said bottom portion extending downwardly beyond said visual display support;

first and second transverse stop plates extending in generally opposing directions from said first support leg between said bottom portion thereof and said visual display support;

a second support leg having a top portion and a bottom portion, said top portion positioned at said second end of said visual display support and said bottom portion extending downwardly beyond said visual display support; and first and second transverse stop plates extending in generally opposing directions from said second support leg between said bottom portion thereof and said visual display support;

said bottom portions of said first and second support legs of said visual display positioned between said at least two gaming machines and said first and second transverse stop plates extending from said first and second support legs of said visual display supported by said at least two gaming machines, whereby said visual display support is supported in an upright position above said at least two gaming machines for viewing.

2. The combination in accordance in claim 1 wherein said first border frame includes one or more pivotable clamp components which are openable relative to said first translucent panel and said second border frame includes one or more pivotable clamp components which are openable relative to said second translucent panel.

3. The combination in accordance with claim 1 wherein said top portions of said first and second support legs are positioned between said first and second border frames.

4. The combination in accordance with claim 1 wherein said at least one light source comprises a plurality of flourescent bulbs, said bulbs positioned between said top portions of said first and second support legs.

5. The combination in accordance with claim 1 wherein said first border frame defines a slot for accepting at least a portion of said periphery of said first display panel and said second border frame defines a slot for accepting at least a portion of said periphery of said second display panel.

6. The combination in accordance with claim 1 including at least one spacer positioned between said first and second border frame to separate said first and second display panels from one another.

7. The combination in accordance with claim 1 wherein said first and second support legs are generally planar metal plates having a first side and an opposing second side and a thickness less than a space between said gaming machines between which said legs are positioned.

8. The combination in accordance with claim 1 wherein said first and second transverse stop plates are generally planar and extend outwardly from said opposing sides of said first and second support legs generally perpendicular thereto.

9. The combination in accordance with claim 1 wherein said at least two gaming machines each have a top and said first and second transverse stop plates extending from said first and second support legs rest upon said tops of said at least two gaming machines.

10. The combination in accordance with claim 1 wherein said at least two gaming machines are arranged in back-to-back orientation and said bottom portions of said first and second support legs extend between rear surfaces of said at least two gaming machines.

11. The combination in accordance with claim 1 wherein said visual display rests upon said at least two gaming machines without connection to said at least two gaming machines.

* * * * *